US005265729A

United States Patent [19]

Carlin

[11] Patent Number: 5,265,729

[45] Date of Patent: Nov. 30, 1993

[54] ARTICLE DISPLAY AND DISPENSING TRAY

[75] Inventor: Glenn Carlin, Kent, Conn.

[73] Assignee: Thomson-Leeds Company, Inc., New York, N.Y.

[21] Appl. No.: 944,352

[22] Filed: Sep. 14, 1992

[51] Int. Cl.[5] ..... B65D 85/672

[52] U.S. Cl. ..... 206/561; 206/557; 220/533

[58] Field of Search ..... 206/561, 557, 454, 456, 206/557, 561; 220/608, 606, 532, 533, 623, 657, 659, 675, 533

[56] References Cited

U.S. PATENT DOCUMENTS

| | | | |
|---|---|---|---|
| 1,998,481 | 4/1935 | Yoder | 206/561 X |
| 2,127,826 | 8/1938 | Meyer | 206/561 |
| 2,554,412 | 5/1951 | Kavanagh | 220/606 X |
| 2,886,828 | 5/1959 | Lattuca | 206/557 X |
| 2,985,333 | 5/1961 | Kirkman | 220/533 |
| 3,567,067 | 3/1971 | Weiss | 206/557 X |
| 3,756,383 | 9/1973 | Kryter | 220/532 X |
| 3,903,641 | 9/1975 | Hoffman et al. | 220/606 X |
| 4,138,015 | 2/1979 | Rabley | 206/561 |
| 4,712,679 | 12/1987 | Lowe | 206/561 X |
| 5,103,998 | 4/1992 | Caro et al. | 220/533 |

*Primary Examiner*—Steven M. Pollard
*Attorney, Agent, or Firm*—Howard C. Miskin

[57] ABSTRACT

An adjustable dispensing and exhibiting tray for adjustably handling articles of different dimension includes an integrally formed base member having a forwardly downwardly inclined base panel with closely transversely spaced longitudinal ribs delineating longitudinal sockets. Partition panels separably engage pre-selected channels to delineate passageways for slidably accommodating articles of corresponding widths. A transverse socket along the base panel front edge engages the bottom border of an upwardly directed stop defining panel. The base member includes side walls with pin engageable notches to facilitate the inclined mounting of the device.

9 Claims, 1 Drawing Sheet

ARTICLE DISPLAY AND DISPENSING TRAY

BACKGROUND OF THE INVENTION

The present invention relates generally to improvements in display and dispensing devices and it relates particularly to an improved tray, shelf or the like for displaying and dispensing articles of varying sizes.

In the merchandising of many products, they are packaged in containers of different sizes, such as cans, bottles, jars or boxes and are exhibited on shelves where they are displayed and may be individually withdrawn. Frequently, the different sized containers are carried on a common tray or shelf and even over a short period of time are commingled by successive purchasers. This requires frequent rearrangement of the products on the tray or shelf or the display becomes confusing and unattractive, difficult and inconvenient to properly observe and select the desired item and highly inefficient and eventually costly.

SUMMARY OF THE INVENTION

A principal object of the present invention is to provide an improved display and dispensing device.

Another object of the present invention is to provide an improved tray, shelf or the like for the display and dispensing of packaged products.

Still another object of the present invention is to provide an improved tray, shelf or the like for positioning product packaged containers such as cans, jars, bottles and boxes of different sizes and dimensions.

A further object of the present invention is to provide an improved tray or shelf for displaying and dispensing container packaged products which may be easily and conveniently adjusted to accommodate containers of different and varying sizes.

Still a further object of the present invention is to provide an improved device of the above nature characterized by its attractive appearance, ruggedness, simplicity and low cost, its ease, convenience and reliability of operation and its great versatility and adaptability.

The above and other objects of the present invention will be come apparent from a reading of the following description taken in conjunction with the accompanying drawing which illustrates a preferred embodiment thereof.

An article display and dispensing device in accordance with the present invention includes a base panel, transversely closely spaced longitudinally extending ribs projecting upwardly from the base panel and delineating transversely spaced longitudinally extending parallel sockets or grooves and transversely spaced partition panels separably engaging and projecting above respective sockets.

In its preferred form, the device is a tray, shelf or the like and the ribs are integrally formed with the base panel and are planar with their sides delineating the parallel side faces of successive sockets. The partition panels have their lower borders engaging respective sockets and are releasably locked in the sockets by compressible gasket members affixed to the partition panel bottom border. The base panel is forwardly downwardly inclined and terminates at its front in a transversely extending socket which is separably engaged by a transversely extending upwardly projecting stop defining transparent front panel. Side walls extend along the side edges of the base panel and are provided with support pin engageable open bottom notches.

The improved device is adjustable to accommodate containers or articles of different widths by adjusting the transverse spacing of successive partition panels and the containers are prevented from intermixing by the partition panels and are gravity advanced to the stop defining front panel. The removable front panel facilitates the easy loading of the device.

DESCRIPTION OF THE PREFERRED EMBODIMENT

Figure 1:
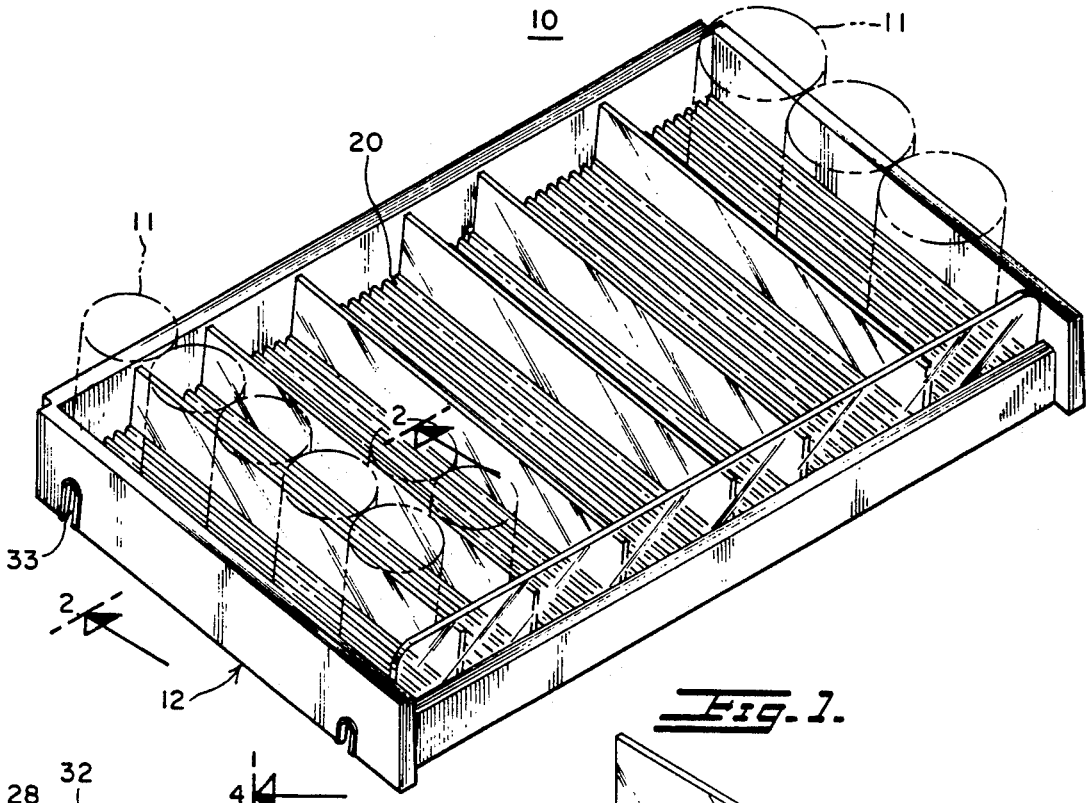
FIG. 1 is a top front perspective view of a tray embodying the present invention.
Figure 2:
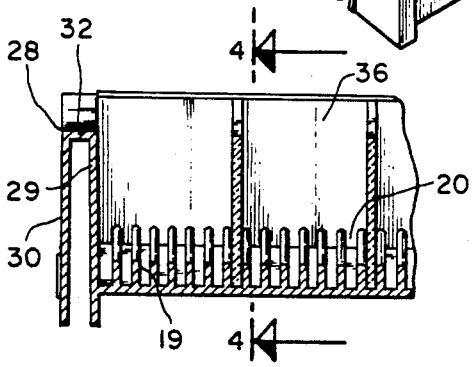
FIG. 2 is an enlarged vertical sectional view taken along line 2—2 of FIG. 1.
Figure 3:
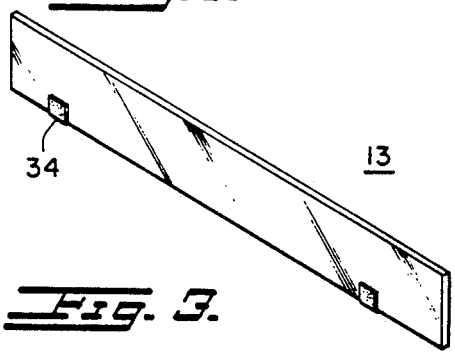
FIG. 3 is a perspective view of a partition panel forming part of the tray.
Figure 4:
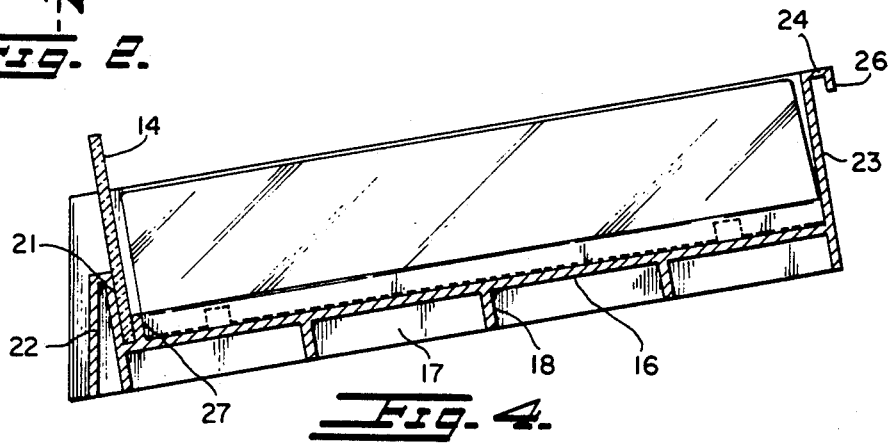
FIG. 4 is a sectional view taken along line 4—4 in FIG. 2.

Referring now to the drawing which illustrates a preferred embodiment of the present invention, the reference numeral 10 generally designates the improved article display and dispensing device which is shown as applied to the merchandising of product containing cylindrical cans 11 illustrated in phantom. The device 10 includes a base member 12, a plurality of similar partition panels 13, and a front stop defining panel 14.

The base member 12 is shown forwardly downwardly inclined, a position in which it is normally positioned and employed and it is injection molded as an integral unit in a conventional manner of any desirable suitable thermoplastic or thermosetting synthetic organic polymeric composition and may be fiber reinforced and may be colored as desired. Base member 12 includes a forwardly downwardly inclined rectangular base panel 16 having longitudinally spaced transversely extending perpendicularly depending reinforcing ribs 17 and depending short side walls 18. Formed on the top face of base panel 16 are transversely equally closely spaced parallel longitudinally extending ribs 19 having opposite vertical faces and being rounded at their upper edges. The confronting faces of successive ribs 19 delineate longitudinally extending narrow open top sockets or channels 20.

Formed along the front edge of base panel 16 is a transversely extending upwardly projecting wall 21 which is perpendicular to base panel 16 which is joined at its top edge by a forwardly projecting flange to a depending vertical front wall 22 which is at a dihedral angle to wall 21. A rear wall 23 is formed perpendicular to and extending along the rear edge of base panel 16 and terminates at its top in a rearwardly projecting flange ending in a depending lip 26 to define a bottom open channel. A transverse rib 27 is formed on the top face of base panel 16 shortly rearwardly of the base of front wall 21 to delineate a front transverse groove.

Inverted open bottom channel shaped side walls 28 are formed along the lengths of the side edges of and project above base panel 16 and are perpendicular thereto. Each side wall 28 includes a pair of transversely spaced inner and outer parallel side webs 29 and 30 respectively and are joined their top edges by cross webs 32. A pair of longitudinally spaced notches 33 reinforced by lips along their edges are formed in the bottom border of each web 30 and facilitate the mounting of device 10 in a forwardly downwardly inclined position by corresponding transversely space suitably supported mounting pins engaged by respective notches 33.

Each of the partition panels 13 are of rectangular shape and are of a length slightly less than the distance between transverse rib 27 and rear wall 23 and of a height about that of rear wall 23. A pair of longitudinally spaced U-shaped gasket members 34 of compressible, preferably elastomeric material engage and are secured to the bottom border of each partition panel 13. The partition panels 13 slidably engage and extend along pre-selected transversely spaced sockets 20 and are releasably retained therein by compressed gaskets 34. The distances between successive partition panels 13 are determined by the widths of articles 11 which are slidably accommodated by the passageways delineated by successive partition panels 13 and between side wall webs 29 and the proximate partition panels 13.

The stop defining panel 14 is preferably transparent and abuts front wall 21 and has a bottom border slidably engaging the bottom socket delineated by front wall 21 and transverse rib 27.

In the operation of the improved display and dispensing device 10, panels 13 have their lower borders inserted into sockets 20 to space panels 13 to delineate longitudinal passageways 36 of widths to confine and permit the linear free longitudinal movement of articles under the influence of gravity along the downwardly forwardly rounded top edges of ribs 19. Thus, when any foremost article 11 is raised and removed from tray 10, the row of following articles 11 advances forwardly until the foremost article abuts the stop panel 14.

While there has been described and illustrated a preferred embodiment of the present invention, it is apparent that numerous alterations, omissions and additions may be made without departing from the spirit thereof.

I claim:

1. An article display and dispensing device comprising a downwardly forwardly longitudinally inclined base panel having parallel side edges, a pair of opposite open bottom channel shaped side walls integrally formed with and extending along said panel side edges, said sidewalls having inner legs integrally formed with said base panel and outer legs having longitudinally spaced mounting notches formed in the bottom edge of said outer legs, a plurality of transversely spaced longitudinally extending ribs integrally formed with and projecting upwardly from said base panel and delineating a plurality of transversely spaced longitudinally extending sockets and a plurality of transversely spaced partition panels separably engaging and projecting above respective sockets and having top edges in a common plane and delineating with said side walls a plurality of side-by-side downwardly forwardly inclined channels extending uninterrupted for the full length of said base panel.

2. The device of claim 1 including means releasably securing said partition panels in said slots.

3. The device of claim 2 wherein said securing means includes a pair of longitudinally spaced compressible U-shaped gaskets engaging the bottom edges of each of said partition panels.

4. The device of claim 1 wherein the top edges of said ribs are rounded.

5. The device of claim 1 including an open top transversely extending front socket located along the forward edge of said base panel and including a front stop wall having a lower edge engaging and extending along said front socket and extending above the top of the front edges of said partition panels.

6. The device of claim 5 wherein said front stop wall is transparent.

7. The device of claim 1 including an open bottom channel shaped wall extending along the front edge of said base panel and including a rear leg perpendicular to and integrally formed with said base panel and a vertical front leg.

8. The device of claim 1 including a rear wall extending along and integrally formed with the rear edge of said base panel and terminating at its top in an open bottom channel shaped lip.

9. The device of claim 1 wherein said base panel includes transversely extending and longitudinally extending reinforcing ribs integrally formed with and depending from the underface of said base panel.

* * * * *